United States Patent [19]

Kawano et al.

[11] Patent Number: 4,971,755

[45] Date of Patent: Nov. 20, 1990

[54] METHOD FOR PREPARING POWDER METALLURGICAL SINTERED PRODUCT

[75] Inventors: Masaki Kawano; Kuniaki Ogura; Shigeaki Takajo; Hiroshi Ohtsubo; Keisuke Yoshimura; Yoshiaki Maeda, all of Chiba, Japan

[73] Assignee: Kawasaki Steel Corporation, Hyogo, Japan

[21] Appl. No.: 369,069

[22] Filed: Jun. 20, 1989

[30] Foreign Application Priority Data

Mar. 20, 1989 [JP] Japan ..... 1-65977
Apr. 11, 1989 [JP] Japan ..... 1-89670

[51] Int. Cl.[5] ..... B22F 3/26

[52] U.S. Cl. ..... 419/10; 419/23; 419/27; 419/32; 419/39; 75/252; 75/255; 264/71

[58] Field of Search ..... 419/23, 27, 32, 39, 419/10; 75/251, 252, 255; 264/71

[56] References Cited

U.S. PATENT DOCUMENTS

| | | | |
|---|---|---|---|
| 4,432,795 | 2/1984 | Andersen | 75/245 |
| 4,554,218 | 11/1985 | Gardner et al. | 428/567 |
| 4,710,223 | 12/1987 | Matejczyk | 75/248 |
| 4,769,071 | 9/1988 | Klar et al. | 75/246 |
| 4,772,449 | 9/1988 | Bones et al. | 419/27 |

*Primary Examiner*—Stephen J. Lechert, Jr.
*Assistant Examiner*—Leon Nigohosian, Jr.
*Attorney, Agent, or Firm*—Austin R. Miller

[57] ABSTRACT

It is disclosed a method for preparing a large-sized powder metallurgical sintered product having a superior characteristic by charging mixtures of three types of metallic powder composed of coarse particles, middle particles and fine particles into the molding die while vibrating it, heating the charged material together with the molding die, sintering them, and infiltrating metal of low melting point into the sintered body. According to this method, it is possible to get a large-sized sintered body having a superior strength and surface smoothness or a sintered body prohibiting any cracks or slits by arranging the proper particle size.

29 Claims, 5 Drawing Sheets

METHOD FOR PREPARING POWDER METALLURGICAL SINTERED PRODUCT

INDUSTRIAL FIELD OF THE INVENTION

This invention relates to a method for preparing a large-sized sintered product having a superior strength and fine surface roughness and made by a powder metallurgical process or a large-sized die.

PRIOR ART

Large-sized sintered products made by the prior art were lack of their economical characteristic due to an expensive cost of die.

The die is normally prepared by machining steel material as by cutting operation etc. However, such a prior art method requires a long machining time and a quite expensive machining cost.

In turn, as various types and small amount of products made by the die are produced, a requirement of low cost and short period of delivery is increased for the die, so that a great concern for a simple die preparing process has been recently promoted.

One of the proposal is, as disclosed in Japanese Patent Laid-Open No. 60-159101, a method for preparing a die under a powder metallurgical process. However, this process showed an insufficient strength, merely enabled to get a strength as applied for the casting die, was lack of general characteristic as a die and so this process could not be applied for a general type of die such as an injection molding die for resin and the like.

In turn, there is a method for infiltrating metal of low melting point in order to improve strength of die as disclosed in Japanese Patent Publication No.56-13763. In this case, although the strength is improved, surface roughness in the die injection surface is not made uniform but made rough due to application of powder of normal particle size. Accordingly, if the die was kept solidified, the die could not be made as a product, resulting in that finally a grinding of longer hours was required and so there was a certain limitation in shortening the lead time for the preparation of the die.

DISCLOSURE OF THE INVENTION

It is an object of the present invention to provide a technology for preparing a die having a superior surface roughness and strength within a short period of time under application of a powder metallurgical process.

It is another object of the present invention to provide a process for using iron-base powder and preparing a large-sized sintered body in low cost.

It is still another object of the present invention to restrict a shrinkage in size due to sintering, prevent deformation or cracks and in turn to prepare a large-sized sintered member having a superior strength and of which surface roughness is restricted to such as degree as one capable of improving to a target roughness under a grinding work of short period of time.

It is yet further object of the present invention to improve a surface roughness of the sintered body and to provide a sintered product having a smooth surface.

In case that metallic powder containing fine particles is applied to reduce a surface roughness of the sintered body, the sintered body may generate a certain shrinkage during its sintering and infiltrating process. In view of this fact, it is an object of the present invention to restrict this shrinkage and to provide a sintered body having no deformation or damage at all.

Another object of the present invention relates to a method for preparing a sintered body under application of the powder metallurgical process and it is further object of the present invention to provide a method for easily getting a sintered body having a smooth surface with a surface roughness Ra of less than 1 μm.

The inventors of the present invention studied a method for preparing a die under application of powder metallurgical process and got a sintered body of which surface roughness was improved. The inventors noted the fact that the preparation of such a sintered body as above only required improvement of a packing density of powder to reduce irregular surface, i.e. adjustment of particle diameter of the charged powder, its amount and charging method and further found that the following method enabled the die having the superior surface roughness and strength to be prepared.

The present invention relates to a method for preparing powder metallurgical sintered body comprising the steps of;

charging mixture of three types of metallic powder composed of coarse particles having substantially a particle diameter of 150 to 1000 μm, middle particles of 15 to 150 μm and fine particles of less than 10 μm into a vibrating mold, each of the coarse particles, middle particles and fine particles being of a continuous particle size distribution and coarse particle size distribution, middle particle size distribution and fine particle size distribution being discrete each other;

heating the charged material together with the mold to sinter the material; and infiltrating into the sintered body metal of which melting point is lower than that of the metal powder.

In case that the sintered body having a superior strength and surface smoothness is mainly prepared by the above-mentioned method, it is usually performed to apply metallic powder substantially having such a range of particle size as one in which the fine particles with a particle diameter of less than 10 μm occupy 10 wt% or more and 50 wt% or less, the middle particles with a particle diameter of 15 μm or more and 63 μm or less occupy 20 wt% or more and coarse particles with a particle diameter of 150 μm or more and 500 μm or less occupy 20 wt% or more and 60 wt% or less of an entire weight percent, respectively.

In order to prevent cracks or slits in a large-sized sintered body and to restrict any shrinkage of it, coarse particles of which sintering is inferior are effectively applied so as to improve to have a proper particle size distribution. In view of a characteristic of smoothness of the surface, if the metal powder having the following features is applied under the above-mentioned process in order to shorten totally the preparing steps including a grinding step, it is possible to get a sintered body having no deformation and cracks.

That is, the metal powder is applied, in which substantially the fine particles with a particle diameter of 10 μm or less are 3 wt% or more and 25 wt% or less, middle particles with a particle diameter of 15 μm or more and 150 μm or less are 30 wt% or more and 60 wt% or less of entire particles, the middle particle with a particle diameter of 63 μm or more being 35 wt% or more against the middle particles with a particle diameter of 15 μm or more and 150 μm or less and coarse particles with a particle diameter of 250 μm or more and 1000 μm or less are 30 wt% or more and 60 wt% or less.

PREFERRED EMBODIMENTS

Figure 1:
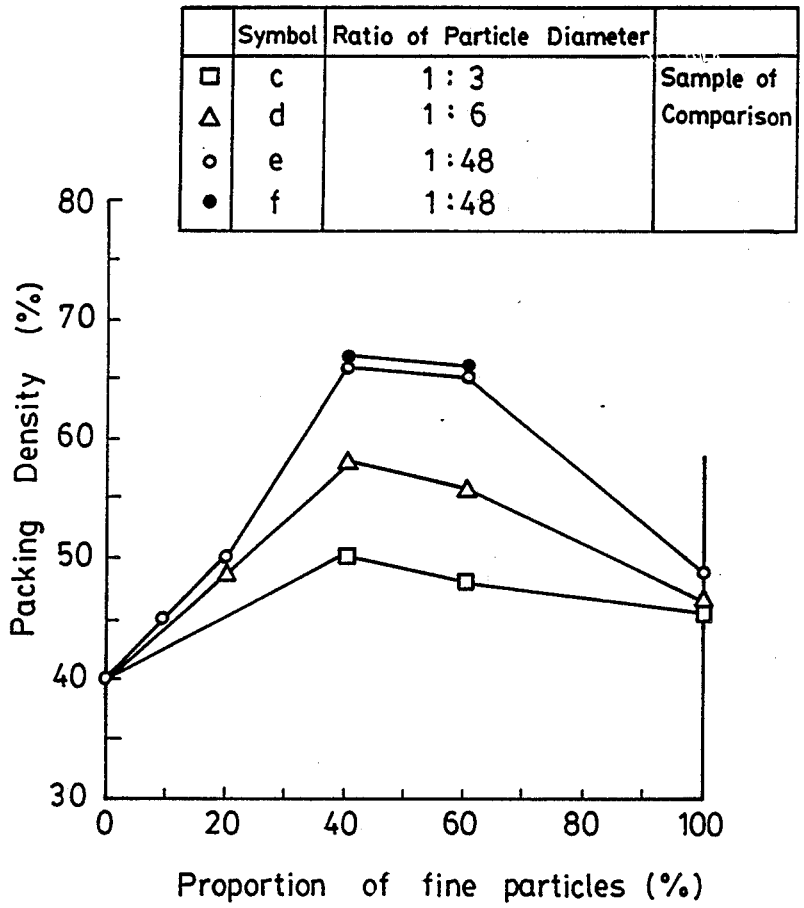
FIG. 1 is a graph for showing influence of an amount of fine particles upon a rate of charging.

As factors influencing over surface roughness of the product constructed in accordance with the present invention, there are particle size of raw material of the sintered body itself or sintering condition and surface roughness of a molding die used in case of preparing the sintered body. In case that surface roughnesses of the sintered body and the molding die used in preparing the same are low, the sintered body can be used as it is or can be used after grinding in a short period of time. If either the sintered body or the molding die used for preparing the same shows a high surface roughness, it becomes necessary to make the surface of the sintered body smooth through machining such as cutting or grinding and the like, and the larger the surface roughness, the more both burden for the machining step and loss caused by machining step.

As the powder to be used as raw material in the present invention, metallic powder is mainly used. If the powder is of normal one to be applied in a normal powder metallurgical process, the powder may be applied. For example, atomized iron powder, reduced iron powder, alloy steel powder and high speed steel powder can be used. All the mixture powders are not necessarily to have the same composition, but mixture of different type of powders having different composition can be applied if they fulfill the following particle diameter and a proportion.

The applied powder is not restricted by its particle shape. Further, it is also possible to apply ceramic powder which may react with metallic powder during its sintering process, generate compound of low melting point and may not generate any remarkable liquid phase. If remarkable liquid phase is generated, its variation in size is remarkable, resulting in that keeping of shape of the powder becomes hard. So, this remarkable liquid phase should be avoided.

Preparation of the sintered body of which strength and surface roughness are noted in particular will be described. Reason why a particle diameter in this case is restricted will be described as follows.

In order to improve surface roughness, its effect can be increased as the fine particles are applied. As fine particles, powder having a diameter of 10 μm or less is necessarily used. Surface roughness is improved by applying powder with a particle diameter of 10 μm or less. However, it is difficult to increase a packing density only by applying powder with this particle diameter, the powder with a particle diameter of 10 μm has more fine particle size as compared with that of the powder metallurgical iron powder of the prior art and this is expensive, so is not practical and it is necessary to mix with it powder having other particle size. Due to this fact, specified amount of powder with a particle diameter of 15 μm or more and 63 μm or less and powder with a particle diameter of 150 μm or more and 500 μm or less are added. Adding of these powders cause each of the particles to sufficiently fill its relative spacing, packing density is improved and an ultimate strength is improved.

A reason why three types of particle diameters are restricted consists in that if only two types are applied, surface roughness becomes rough even if the packing density is improved. That is, in order to improve a packing density with two types of powder, it is necessary to have a large ratio of particle diameters (a particle diameter ratio between fine particles and rough particles). In general, powder with a particle diameter of 10 μm or less may easily be sintered and compacted, so that shrinkage in size becomes several percents. In turn, since shrinkage in size of the coarse particles is quite low as compared with that of fine particles by a few percent, shrinkage in size shows several percent. In turn, since shrinkage in size of the coarse particles is quite low as compared with that of fine particles by several percent less than a decimal point, so that if the material-mixed with these compounds is sintered, a surface of the sintered body is corrugated and its packing density is improved. However, surface roughness becomes excessively poor. Then, if the third particles having an intermediate particle diameter between that of coarse particles and fine particles are applied, shrinkage caused by sintering of the fine particles can be restricted.

As described above, full application of fine particles with a particle diameter of 10 μm or less causes a better sintering characteristic, but its packing density is not increased and shrinkage in size is excessive, so that it is necessary to avoid this. In addition, it may provide a superior sintering characteristic and may easily form a closed pore during sintering operation and as described later, infiltration of the infiltrating agent into open pores is excessively prohibited during the process of infiltration after sintering work. Accordingly, full application of fine particles with a particle diameter of 10 μm or less should be avoided.

As described above, in order to improve surface roughness and further improve strength through improvement of density, it is necessary to provide composite powder body having three specified types of particle size distribution.

A reason why the maximum limited particle diameter in the coarse particle is restricted to have 500 μm consists in the fact that a shape of the molding die, for example, a flowing of powder into the thin part such as a rib of a thickness of about 2 mm is prohibited and a shape transfer becomes insufficient.

Further, a particle diameter and a proportion of these powders are important and then it is necessary that a total of powder composite with a particle diameter of 10 μm or less is 10 wt% or more and 50 wt% or less, powder with a particle diameter of 15 μm or more and 63 μm or less is 20 wt% or more of the entire amount and powder with a particle diameter of 150 μm or more and 500 μm or less is 20 wt% or more and 60 wt% or less of the entire amount. A reason why the middle particles and coarse particles are restricted by more than 20 wt% consists in the fact that a less value than 20 wt% does not provide any effect got under the restriction of the middle and coarse particles, a packing density is not improved and au ultimate strength becomes insufficient.

A reason why a proportion of coarse particles is restricted by 60 wt% or less consists in the fact that a value more than 60 wt% may cause a surface roughness rough.

A reason why a proportion of powder with a particle diameter of 10 μm or less is restricted to 10 wt% or more and 50 wt% or less consists in the fact that powder with a particle diameter of 10 μm or less may provide a great influence over a surface nature of the product. That is, if a total of the powder composite with a particle diameter of 10 μm or less is lower than 10 wt%, the surface roughness becomes rough due to less amount of fine particles and in turn if the amount exceeds 50 wt%, the surface of the sintered body may generate a corrugated form due to a shrinkage at the region of fine particles as described above and the surface roughness becomes excessively rough.

So, it is necessary that a total amount of these three particles is more than 90 wt% in respect to a total weight of the powder, because, if the total value is lower than 90 wt%, the packing density is remarkably decreased due to powders out of the specified region and then a target strength can not be attained.

Preparation of a large-sized sintered body in which shrinkage in size caused by sintering is restricted and either deformation or cracks is prevented will be described as follows. In this case, although the surface roughness becomes rough, it is assumed a surface roughness can be allowed up to such a degree as one in which the time required for improving the surface roughness through grinding operation is short as compared with that required for modifying cracks or deformation. Powder with a particle diameter of 10 μm or less has a superior sintering characteristic and may generate a remarkable shrinkage of several percents under a normal sintering temperature (approximately 1000° C. or more), so that other powder with different particle size should be mixed with it in order to accommodate for the shrinkage. In order to get this effect, a specified amount of powder with a particle diameter of 15 μm or more and 150 μm or less and another specified amount of powder with a particle diameter of 250 μm or more and 1000 μm or less are added. Adding of these powders causes each of the particles to sufficiently charge their spacings to each other, a packing density to be improved and then a final strength is improved. In addition, a large amount of coarse particles with less sintering characteristic, in particular powder with a particle diameter of 500 μm or more enables shrinkage caused by sintering to be restricted.

Particle diameter and proportion of these powders are important and it is needed that a total amount of powders with particle diameter of 10 μm or less is 3 wt% or more and 25 wt% or less of entire powder, powder with a particle diameter of 15 μm or more and 150 μm is 30 wt% or more and 60 wt% or less of entire powder, the powder with a particle diameter of 63 μm or more is more than 35 wt% in regard to powder with a particle diameter of 15 μm or more and 150 μm or less and exceeds a particle diameter of 250 μm, powder with a particle diameter of 1000 μm is 30 wt% or more and 60 wt% or less of entire amount, and powder with a particle diameter of 500 μm or more contains 35 wt% or more in regard to powder with a particle diameter of 250 μm or more and 1000 μm or less. A reason why each of the middle particles and coarse particles is restricted to 30 wt% or more consists in the fact that if the value is less than 30 wt%, an effect got through restriction of middle particles and coarse particles is eliminated, the packing density of the mixed powder is not improved, a final strength becomes insufficient and further shrinkage in size becomes excessive, thereby the sintered body may generate some cracks or remarkable deformation.

A reason why the weight of coarse particles is restricted to 60 wt% or less consists in the fact that if it exceeds 60 wt%, a remarkable surface roughness may be generated. In addition, a reason why a proportion in the coarse particles with a particle diameter of 500 μm or more and 1000 μm or less is 35% or more consists in the fact that if the powder is less than 35 wt%, i.e. powder with a particle diameter of 250 μm or more and 500 μm is more than 65%, the effect of restricting in size to get coarse particles is remarkably reduced due to a decreasing of packing density and a shrinkage under sintering of powder with a particle diameter of 250 μm and 50 μm, and finally the sintered body may generate a remarkable deformation or cracks.

A reason why the weight of middle particles is restricted to 60 wt% or less consists in the fact that if the weight exceeds 60 wt%, a packing density of mixed powder is not improved in the same manner as that of weight of 30 wt% or less and the shrinkage caused by a sintering action is promoted under an influence of the packing density. Further, a reason why a proportion of particles of the middle particles with a particle diameter of 63 μm or more and 150 μm or less is restricted to 35% or more consists in the fact that if the powder has a value of 35 wt% or less, i.e. powder particle with a particle diameter of 63 μm or less is 65% or more, a remarkable deformation or cracks of the final sintered body may be generated due to a reduction of packing density and shrinkage of the powder with a particle diameter of 63 μm showing a better sintering feature. A reason why a proportion with a particle diameter of 10 or less is restricted to 3wt% or more and 25 wt% or less consists in the fact that as described above powder with a particle diameter of 10 μm may influence substantially over a surface nature, a packing density and a sintering characteristic. That is, if a total amount of powder composite with a particle diameter of 10 μm or less is lower than 3 wt%, a less amount of fine particles can not fulfill sufficiently the clearances formed between the middle particles and coarse particles and a remarkable increase of roughness may be generated. If the amount exceeds 25 wt%, as described above, the amount of shrinkage is excessively increased and the sintered body may cause deformation or cracks.

So, it is necessary for a total amount of three specified types of particles is more that 90 wt% in regard to a total weight of powders. Because, if the amount is less than 90 wt%, the packing density is remarkably decreased with the non-specified powder, a target strength may not be attained or an amount of shrinkage is increased or a deformation or cracks may be generated.

Metal fibers are mixed with the powder having the above-mentioned configuration of particle size within a range not exceeding 15 wt%, thereby an effect of restricting shrinkage in size and improvement of strength can be attained. As the short metallic fibers, one having the same constituents as that of the particles and the other having different constituents can be applied. In order to improve strength, fibers having different feature are preferable.

Although details of action of the added metallic short fibers are not apparent, it may be considered that shrinkage of particles is restricted through bridging of the short fibers by themselves and their effects in view of their strength may contribute to a reinforcement of matrix of particles (including infiltrating agent) similarly to a reinforcement of the matrix of the short fibers as found in the composite materials such as normal FRM and FRP etc. Accordingly, as a size of the short fiber, it is preferable to have about that of particles or more so as to perform an effective restriction over shrinkage through bridging action. If the adding amount of short fibers exceeds 15 wt%, the packing density is remarkably decreased and the amount of shrinkage during sintering operation caused by a decreasing of density is remarkably increased to generate some disadvantages such as cracks of sintered body and so the range not exceeding 15 wt% is required.

In addition, application of spherical powders as proper shape of particles in order to improve the characteristic may provide a more efficient effect. Irregular shape powders may generate a limit over an increasing in packing density due to surface roughness. Spherical particles increase a packing density more and may reduce remarkably a shrinkage of the product during sintering operation. It may be assumed that this is caused by improvement of flowing of powder and a geometrical reduction of powder clearance.

The spherical powder may be prepared by any means such as various mills and any other means. As a parameter of degree of making spherical powder, a degree of flow (F.R) is effective in case of atomized powder (about 100 #(150 μm) or so) to be applied in the normal powder metallurgical application, and if FR = 16 sec/50 g or more is applied as a degree of spherical formation, it may be assumed that the powder is spherical powder. In case of coarse particles of which measurement of FR is impossible, if a ratio (a/b) between a long diameter (a) and a short diameter (b) of the particle is within 1 to 1.3.

Then, it will be described a case in which either aluminum powder or non-metallic powder is mixed with iron-base powder of raw material powder and this mixture powder is applied. As required, graphite powder or other metallic powder or elements which can be made as alloy during sintering operation so as to improve a mechanical characteristic or the like may be mixed more.

Mixing of aluminum powder or non-metallic powder is needed in order to restrict shrinkage of sintered body during sintering and infiltrating and further to get such a sintered body as one having less surface roughness. Although an acting mechanism of aluminum powder is not apparent, it may be considered that the aluminum powder is melted through its increased temperature, the molded product may expand during a process to react with the iron powder, resulting in that the shrinkage of the formed body through sintering operation is accommodated.

Although a mixing amount of aluminum powder is not limited, it is appropriate that 1 to 15 wt% is applied in respect to a total amount of iron-base powder and aluminum powder.

According to the experiment performed by the inventors, an amount of shrinkage of the sintered body during sintering and infiltrating is linearly reduced and its rate of reduction of shrinkage is about 1% per 1 wt% of aluminum powder. Since the rate of shrinkage in case of no mixing of aluminum powder is a maximum value of 10% or so, mixing of 15 wt% may sufficiently restrict the shrinkage and an amount of 1 wt% has less effect.

A particle size of the aluminum powder is preferably within a range of a mean particle diameter of 1 to 500 μm due to the fact that if the mean particle diameter is lower than 1 μm in relation with a charging characteristic of mixed powder after mixing with the iron-base powder and a surface roughness of the sintered body, the charging characteristic of mixed powder is deteriorated, and in turn if the mean particle diameter exceeds 500 μm, the surface roughness of the sintered body is increased.

Although purity of aluminum powder is not limited so long as the characteristic of the sintered body is not deteriorated, it is preferable to have a total amount of impurities less than 20%.

Acting mechanism of the non-metallic powder may be considered as one in which a final shrinkage in size is restricted by expelling out the sintering phenomenon. Shape of the non-metallic powder is not restricted, but short fibrous powder such as powder form or wisker to be normally used in ceramic material can also be applied. Although the mixing amount is not restricted either, weight of less than 70 wt% is appropriate for the weight of powder with a particle diameter of 10 μm or less contributing to the shrinkage of the iron-base powder. According to the experiment performed by the present inventors, if the rate exceeds 70%, the effect of addition of metallic powder with a particle diameter of 10 μm or less is decreased and it is sometimes found that strength of the final sintered body is deteriorated and this is not preferable. A particle size of the nonmetallic powder is preferably 500 μm or less since the surface roughness of the sintered body is increased if a mean particle diameter exceeds 500 μm and its mean particle diameter of at least 0.1 μm or more is preferable. In case of short fiber powder, a short diameter is applied as a representing diameter, thereby it may be accommodated for normal powder. As the non-metallic powder, its kind may not be restricted if it does not show any remarkable liquid phase when the iron-base powder such as alumina($Al_2O_3$) and silica ($SiO_2$) etc. are to be sintered. It is also possible to apply powder having additives mixed with the infiltrating metal or coated in the surface of the non-metallic powder in order to improve a wetting characteristic with the infiltrating metal.

In turn, the iron -base powder may occupy almost half of the raw material powder, either pure iron powder or alloy steel powder is used in response to a requirement of characteristic of the sintered body. For example, fine powder with a maximum particle diameter of 500 μm and other particle diameters of 10 μm or less is preferably applied.

Powders prepared as above are mixed to each other. Although the mixing process is performed with a normal V-type mixer or a double-corn type mixer, if the mixer is one in which a grain size configuration is not varied through grinding action, the mixer is not limited to this type. It is also applicable to add graphite powder during mixing operation.

These mixtures are filled in the molding die prepared in advance. The molding die may be applied if powder shows an improved strength through sintering and its strength is sufficiently kept until such a temperature as one in which the shape of the molding die is correctly transferred is attained and the transferring of the molding die is not damaged through an excessive reaction with the powder. Normally, a ceramic die capable of keeping strength up to a hot temperature is used. Its preparing method may be of a machining work or a preparing method of the ceramic die to be used in a precision casting, and in brief, any preparing methods can be applied if a superior roughness of the transferring surface could be attained and a superior strength could also be attained.

The charging operation is carried out under a dry condition and a vibration is applied to improve a packing density. With this vibration, an effect of the particle size distribution of the powder above can be improved more. The vibrating method may be carried out with an electromagnetic vibration and a mechanical vibration and any other methods. Conditions of performing vibration can be expressed with a frequency f (Hz), an acceleration a (G) and an amplitude d (mm) and these elements have a relation of $$a=(2\pi)^2(d/2)/980$$

and so if the above two parameters are determined, the vibrating condition can be defined. When the powder is to be vibrated and filled, the vibration is carried out with acceleration of 0.5G or more and the amplitude of 20 μm, thereby the packing density is sufficiently increased.

Because if the acceleration is decreased lower than 0.5G, movement of particles is excessively prohibited and this is not influenced by variation of amplitude, so that the packing density is not improved. If the amplitude is lower than 20 μm, effect of vibration is not attained, and the powder is not sufficiently filled.

In addition, a charging characteristic can be improved by applying a quite lower pressure than that of the conventional type of hot press molding process. Although it is sufficient to have this pressure as one in which the molding die is not damaged, normally a pressure of 1 kg/cm$^2$ or less is applied. This has an advantage that the charging characteristic is not only improved by the pressurizing action, but also a transferring characteristic at the edge part of the molding die is improved. Since applying such a charging method as above enables a large-sized product to be molded less-expensively and easily without using any expensive pressing machine to be used in the normal powder metallurgical process, the present invention is quite suitable for a preparation of the injection molding die having a wide area of 1 m×1 m.

It will be described a case in which prior to the filling of metallic powder into the molding die, the layer with a thickness less than 10 mm composed of metallic powder with a mean particle diameter of 20 μm is adhered and formed on the surface of the molding die.

As powder to be adhered to the molding die, powder with a mean particle diameter of 20 μm or less is used and its thickness is required to have a value of 10 mm or less. In order to improve the surface roughness, application of fine particles is quite effective. If the mean particle diameter of the fine particles exceeds 20 μm, the surface roughness after sintering operation is Ra exceeding 1 μm and thus an effect of coating of particles to the surface is eliminate. A reason why the thickness is restricted a value less than 10 mm consists in that if the value exceeds 10 mm, some cracks are generated during sintering operation. The cracks may be generated due to a difference between the rate of shrinkage of the filling powder and the rate of shrinkage of the fine powder.

Although the adhering process is not restricted in particular, a process for coating powder dispensed into the solvent medium and a process for coating it with spray and the like can be applied. Further, it is also possible to apply a method in which a specified amount of slurry melted in the solvent medium is flown into the molding die, the molding die is inclined and then the surface of the die can be uniformly coated with the adhering powder. This process is quite effective for the molding die having a complex shape. Upon adhering, it is also applied that a pre-sintering is performed before charging of the charging powder in order to prevent a peeling-off of the adhered powder at the surface of the die.

Upon adhering, the charging powder is filled in the adhered molding die. A charging process is preferably carried out by applying vibration or tapping operation.

The molding die may be one to cause the powder to improve strength through sintering operation, its strength is sufficient up to such a temperature as one where a correct transferring of the shape of the molding die is performed and the transferring of the molding die is not damaged through an excessive reaction with the powder. Normally, a ceramic die capable of keeping a strength up to a high temperature is used. A shape of the molding die is one in which the sintered body may keep its own shape after sintering process or a shape capable of performing a function without applying any excessive work. Its preparing method may be performed by a machining work or by a preparing method for the ceramics die and in brief if the process is superior in making roughness of the transferring surface and having a superior strength, any preparing process can be applied.

Then, the molding die (filler material) charged with powder is inserted into the furnace as it is and then a sintering action is carried out. As described above, it is necessary for the molding die to keep its strength until such a temperature as one in which the powder may generate the strength produced by the sintering operation. The sintering operation is carried out within reducing atmosphere, inert gas atmosphere or vacuum, and after sintering the molding die is removed.

Since the produced sintered body has no sufficient strength required in a die as it is, voids remained in the sintered body are infiltrated by metal of lower melting point than the sintered body. The infiltrating operation can be carried out within the reducing atmosphere, inert gas atmosphere or vacuum. As the infiltrating materials, a metal which has a lower melting point than the sintered body can be applied. The proper materials for infiltration are some metals such as copper, copper alloy, zinc, zinc alloy, aluminum alloy, nickel alloy, lead, lead alloy, tin and tin alloy. Copper, copper alloy, zinc or zinc alloy is more suitable for infiltrating into the sintered body which consists of iron-base powder. As an infiltrating amount, it is necessary to have such an amount as one in which a ratio of density of the actual infiltrating substance in respect to a degree of vacuum is more than 90% and in case that the value is less than this value, an irregular infiltrating state is generated and a hardness and a strength are reduced due to a local presence of the remained voids. The strength of the product can be improved under an effect of grain size configuration of the above-mentioned powder and another effect of infiltrating operation, then a target die strength can be kept.

Even if the sintering, infiltrating steps are carried out in one step, i.e. by one heat cycle, an attained effect may not be varied. Making this in one step has an advantage in which the die preparing step can be reduced.

Employing the above-mentioned preparing method enables the die preparing step to be remarkably shortened and in addition, it is possible to prepare a die which is superior in its surface roughness and strength, respectively.

PREFERRED EMBODIMENTS

Preferred Embodiment 1

As indicated in Table 1, atomized pure iron powder having different particle diameter and atomized alloy steel powder are classified and prepared. The alloy steel powder has a composition corresponding to 4600 of AISI Standard (2Ni-0.5Mo).

These powders were mixed by the V type mixer to make two types of mixtures and three types of mixture powders as indicated in Table 2. The inventors checked the two types of mixture powder by varying a particle diameter region and a rate of weight and surveying a variation of packing density and then compared it with the three types of mixture powder based on the present invention. In Table 2 are indicated a particle size distribution and a rate of weight in reference to the present invention and the example of comparison.

Charging was carried out under a condition of the acceleration of 0.5 G or more, an amplitude of 20 μm or more, for ten minutes and the maximum packing density. The molding die for use in charging operation was made by a shaw process in which a ceramic die is prepared by using a wooden die and a silicon rubber die.

The molding die charged with the powder was sintered at 1000° C. for one hour. After sintering operation, the die was removed, copper infiltrating agent was placed on the sintered body and the infiltrating operation was carried out at 1120° C. for thirty minutes. The copper infiltrating material was placed while the actual injection surface of the die was directed downwardly and the infiltrating material was not directly contacted with the injecting surface. Since direct contact may cause the infiltrating material to be adhered after infiltrating operation and further cause the surface to have irregular surface, the material is not directly contacted. An amount of copper infiltrating agent was selected as one in which voids of the sintered body were sufficiently fulfilled. A shape of the infiltrated sintered body is approximately 200 mm (longitudinal)×200 mm (lateral)×60 mm (height) and its surface has a three-dimensional curved surface. Transverse rupture strength was calculated with a test piece of 6 (height)×10 (width)×35 (length) mm obtained from the infiltrated sintered body.

Figure 2:
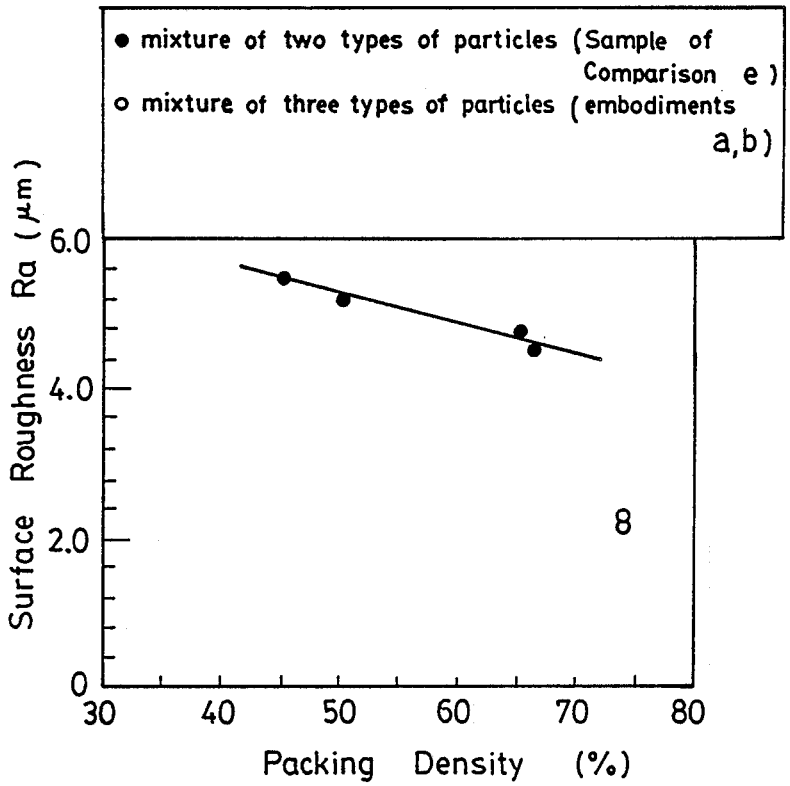
FIG. 2 is a graph for showing a relation between a surface roughness and a packing density.

In Table 2 is indicated the example of the present invention and the example of comparison as well as a packing density, a surface roughness, a strength (transverse rupture strength) and a hardness are indicated. These relations are illustrated in FIGS. 1 and 2. In reference to Table 2 and FIG. 1, it is apparent that two types of particles may not overcome the material of the present invention even if a ratio of particle diameter is 48 irrespective of the fact that the packing density of the material of the present invention may easily reach 74%. In addition, it is apparent from Table 2 and FIG. 2 that the material of the present invention is quite superior than the comparison material in view of its surface roughness and the surface roughness can be improved by applying three types of particles. Further, the present invention is superior for strength (transverse rupture strength) and hardness in case of applying same type of steels. Applying of the alloy steel powder causes the strength and hardness to be improved more. Even in case of applying alloy steel powder, two types of steel powder may not improve the surface roughness similarly in case of pure iron, so that the surface roughness does not depend upon a powder composition, but substantially depends upon the particle size distribution.

TABLE 1

| Type | Symbol | Mean Particle Diameter (μm) | Particle Diameter (μm) | Ratio of Particle Diameter |
|---|---|---|---|---|
| Pure | A | 230 | −500/+150 | 48 |
| Iron | B | 85 | −150/+63 | 17.7 |
| Powder | C | 29 | −63/+15 | 6 |
| | D | 4.8 | −10 | 1 |
| Alloy | E | 230 | −500/+150 | 48 |
| Steel | F | 86 | −150/+63 | 17.7 |
| Powder | G | 29 | −63/+15 | 6 |
| | H | 4.8 | −10 | 1 |

TABLE 2

| No. | Mean Particle Diameter (fine:middle: coarse) | Proportion (%) (fine:middle:coarse) | Powdered Used | Packing Density (%) | Surface Roughness (Ra) | Transverse Rupture Strength (kgf/mm$^2$) | Hardness HRB |
|---|---|---|---|---|---|---|---|
| Preferred Embodiment a | D:C:A = 1:6:48 | D:C:A = 20:30:50 | A, C, D | 74 | 2.3 μm | 141 | 85 |
| Preferred Embodiment b | H:G:E = 1:6:48 | H:G:E = 20:30:50 | E, G, H | 73 | 2.2 μm | 140 | 101 |
| Example of Comparison c | C:B = 1:3 | C:B = 0:100 | B, C | 41 | — | — | — |
| | | 40:60 | | 50 | — | — | — |
| | | 60:40 | | 48 | — | — | — |
| | | 100:0 | | 46 | — | — | — |
| Example of Comparison d | D:C = 1:6 | D:C = 0:100 | C, D | 41 | — | — | — |
| | | 20:80 | | 49 | — | — | — |
| | | 40:60 | | 58 | — | — | — |
| | | 60:40 | | 56 | — | — | — |
| | | 100:0 | | 47 | — | — | — |
| Example of Comparison e | D:A = 1:48 | D:A = 0:100 | A, D | 41 | — | — | — |
| | | 10:90 | | 45 | 5.5 μm | 105 | 70 |
| | | 20:80 | | 50 | 5.2 μm | 107 | 70 |
| | | 40:60 | | 66 | 4.5 μm | 120 | 79 |
| | | 60:40 | | 65 | 4.8 μm | 125 | 78 |
| | | 100:0 | | 49 | — | — | — |

TABLE 2-continued

| No. | Mean Particle Diameter (fine:middle: coarse) | Proportion (%) (fine:middle:coarse) | Powdered Used | Packing Density (%) | Surface Roughness (Ra) | Transverse Rupture Strength (kgf/mm$^2$) | Hardness HRB |
|---|---|---|---|---|---|---|---|
| Example of Comparison f | H:E = 1:48 | H:E = 40:60 60:40 | E, H | 67 66 | 4.7 μm 5.0 μm | 140 146 | 88 89 |

Preferred Embodiment 2

Powder having different particle size distributions (−10 μm, −63 μm/+15 μm, −500 μm/+150 μm) was prepared by classifying the atomized pure iron powder. A mean particle diameter was as indicated in Table 1. Further, the inventors prepared powder having a different particle size distribution of −15 μm/+10 μm, or −150 μm/+63 μm. They were mixed in respective proportions indicated in Table 3.

Then, the inventors made infiltrated sintered bodies in the same manner as that of the preferred embodiment 1. The surface of the molding die was ground with Emery paper to have a roughness Ra up to 0.1 μm and then a required time was measured.

In Table 3 are indicated a surface roughness, strength (transverse rupture strength), packing density and a ratio of required time up to a grinding finish of the surface (the preferred embodiment g is 1) of the produced infiltrated sintered body. The powder having −63 μm/+15 μm and −500 μm/+150 μm and less than 20 wt% and the powder having −10 μm and less than 10 wt% shows a decreased packing density, a rough surface roughness and inferior strength (transverse rupture strength). The surface roughness is also increased by the fine powder of −10 μm exceeding 50 wt%. At this time, the packing density is not so decreased, thus these may be considered as an increase of roughness caused by a local shrinkage under increased amount of fine particles and so an increased packing density may not necessarily be led to an improvement of the surface roughness.

If a total amount of −10 μm, −63 μm /+15μm, −500 μm/+150 μm does not reach 90 wt%, a packing density is not improved and a strength is also deteriorated. If these are more than 90 wt%, a packing density and a strength are not influenced so much and a high quality can be attained. Further, the smaller the surface roughness after infiltration, the less the grinding time, and it is apparent that it may be reduced down to about ¼.

Preferred Embodiment 3

Mixed powder having three types of powder (A, C, D) of the atomized pure iron powder applied in the preferred embodiment 1 was used and the sintering was performed in the same manner as that of the preferred embodiment 1.

At this time, the condition of the vibratory charging was varied to control a density of the final infiltrated sintered body. An amount of copper at that time (weight of copper/weight of infiltrated sintered body)×100=25 was made constant.

Figure 3:
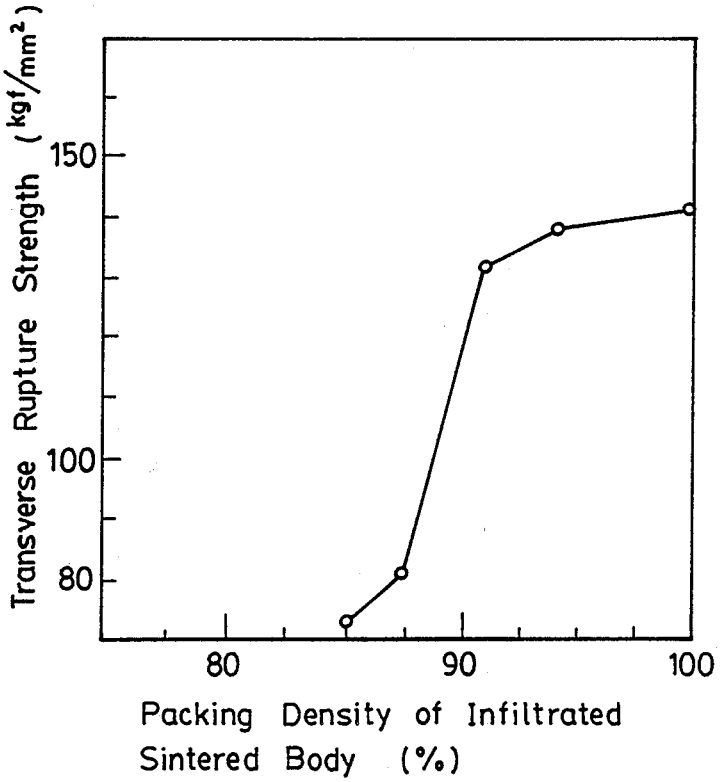
FIG. 3 is a graph for showing influence of a packing density of infiltrated sintered body upon strength (transverse rupture strength).

In FIG. 3 is indicated a relation between the strength (transverse rupture strength) of infiltrated sintered body and its density. In case of a packing density less than 90%, the strength is excessively deteriorated and so the packing density of the infiltrated sintered body is required to be more than 90%.

TABLE 3

| No. | Mixing Rate (wt %) −10 μm | −63 μm~+15 μm | −500 μm~+150 μm | Others | Packing Density (%) | Surface Roughness Ra (μm) | *Grinding Time Ratio | Transverse Rupture Strength (kgf/mm$^2$) |
|---|---|---|---|---|---|---|---|---|
| Preferred Embodiment | | | | | | | | |
| g | 20 | 30 | 50 | 0 | 74 | 2.3 | 1 | 141 |
| h | 30 | 35 | 35 | 0 | 73 | 2.0 | 1 | 139 |
| i | 15 | 35 | 50 | 0 | 70 | 2.5 | 1 | 138 |
| j | 19 | 28 | 47 | 6 | 70 | 2.5 | 1 | 136 |
| Example of Comparison | | | | | | | | |
| k | 17 | 25 | 43 | 15 | 63 | 4.2 | 4 | 120 |
| l | 8 | 42 | 50 | 0 | 60 | 4.0 | 5 | 110 |
| m | 10 | 20 | 70 | 0 | 55 | 6.0 | 7.5 | 105 |
| n | 38 | 15 | 47 | 0 | 66 | 3.8 | 4.1 | 121 |
| o | 40 | 45 | 15 | 0 | 62 | 4.2 | 5 | 114 |
| p | 60 | 15 | 25 | 0 | 65 | 5.5 | 7 | 120 |

Note
*indicates a ratio of grinding time until Ra = 0.1 μm is attained. Grinding is carried out with Emery sheet.

Preferred Embodiment 4

Mixed powder having three types of powder (A, C, D) of the atomized pure iron powder used in the preferred embodiment 1 was used and the sintering was carried out in the same manner as that of the preferred embodiment 1.

At that time, the condition of vibratory charging was varied to vary a packing density and then an amount copper of the final infiltrated sintered body was controlled. Then, a transverse rupture strength and a surface roughness of the material having a packing density of the infiltrated sintered body more than 99% was measured.

Figure 4:
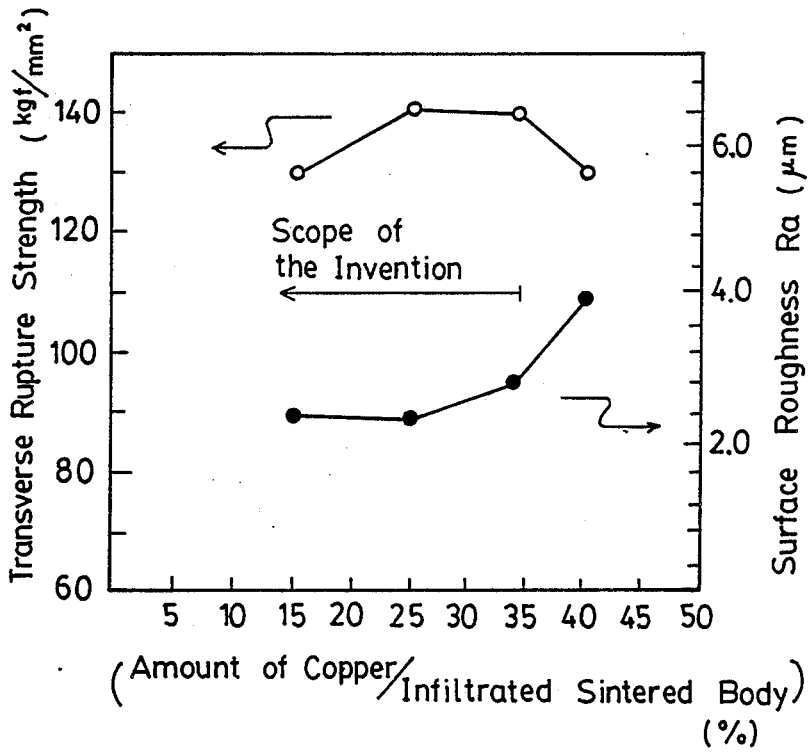
FIG. 4 is a graph for showing influence of an amount of copper upon transverse rupture strength and surface roughness.

In FIG. 4 is indicated influence of an amount of copper upon the transverse rupture strength and the surface roughness. Even if the packing density is more than 90%, it is apparent that, if the amount of copper exceeds 35 wt% in respect to the infiltrated sintered body, the surface roughness is increased.

Preferred Embodiment 5

Mixed powder having three types of powder (A, C, D) of atomized pure iron powder used in the preferred embodiment 1 was used and the packing density when the vibratory condition was varied.

A shape of the container was 50 (diameter)×50 (height) mm and the vibrating time was 10 minutes.

Figure 5:
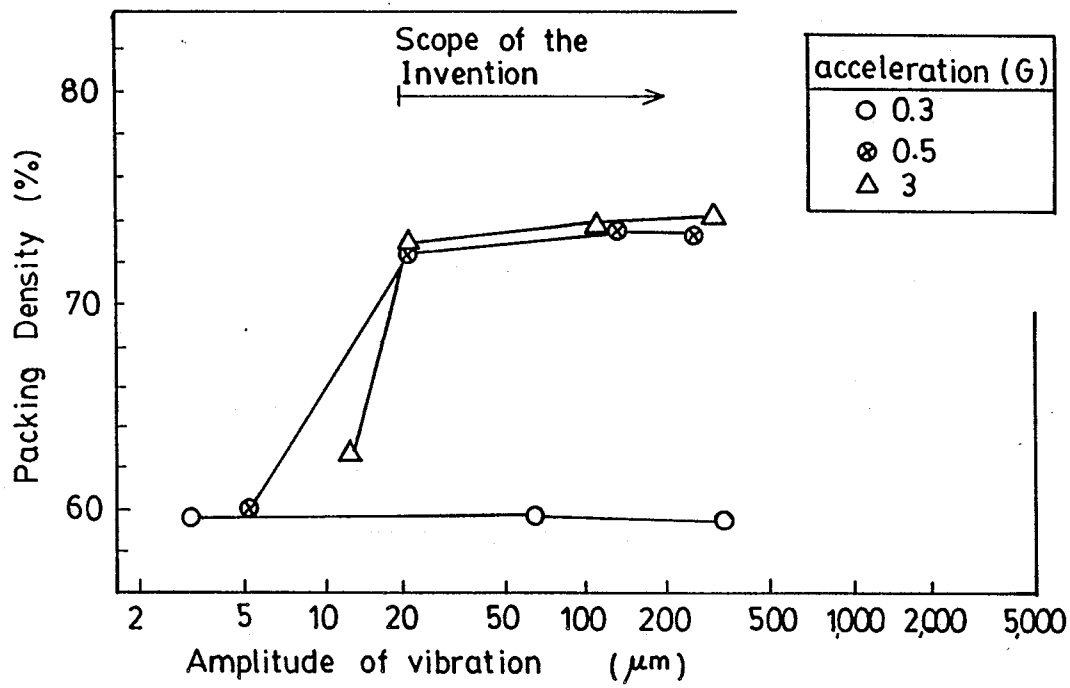
FIG. 5 is a graph for indicating influence of condition of vibration upon packing charging density.

In FIG. 5 is indicated a vibratory condition (amplitude) influenced over the packing density. In order to improve the packing density, it is necessary to have an acceleration of 0.5 G or more and an amplitude of 20 μm or more.

Preferred Embodiment 6

As iron-base powder, powders having a particle size range of −10 μm, 15 to 150 μm, 250 to 1000 μm were prepared. Powder of −10 μm was carbonyl iron powder with a mean particle diameter of 4.2 μm and powders of 15 to 150 μm and 250 to 1000 μm were atomized pure iron powders.

These powders were mixed by V type mixer to make mixed powder having a predetermined rate of weight as indicated in Table 4. The rate of weight was varied and then the variation of the characteristic was surveyed. In Table 4 are indicated the present invention and the examples of comparison.

The charging operation was carried out with an acceleration of 0.5 G or more and an amplitude of 20 μm or more for ten minutes and under a condition in which the packing density showed the maximum value. The molding die for charging was made in accordance with the shaw process for making a ceramic die by using the wooden die and silicon rubber die. On the surface of the body charged with those powders, was placed a copper infiltrating material which had been formed into a block with copper alloy powder by preparing. The ceramic mold, powder charged body and infiltrating material were put into a furnace, heated in a nitrogen gas atmosphere for 70 minutes at 1010° C. to sinter the charged body, and thereafter they were heated up to 1130° C. for two hours, in order to infiltrate the melted infiltrating material into the sintered body. A holding time at 1130° C. was 100 minutes and after that the furnace was cooled down. A shape of the infiltrated sintered body was approximately 200 mm (longitudinal)×200 mm (lateral)×60 mm (height) and the surface had a three-dimensionally curved surface.

After cooling, the infiltrated sintered body was taken out of the ceramic mold, its size was measured and a shrinkage rate of it during the sintering and infiltrating was calculated.

In Table 4 are indicated a surface roughness, a packing density, a ratio of grinding time and a relation between a shrinkage rate and cracks in reference to embodiments of the present invention as well as examples of comparison.

Preferred embodiments b and c were prepared as variations of the preferred embodiment a in which a proportion of fine particles (−10 μm) was varied while keeping the ratio of the middle particles 15 to 150 μm) to coarse particles (250 to 1000 μm) as constant, and these embodiments correspond to the examples of comparison i and j. The preferred embodiments d and e were prepared as variations of the preferred embodiment a in which a proportion of middle particles (15 to 150 μm) was varied while keeping the ratio of the fine particles to coarse particles as constant, and these embodiments correspond to the examples of comparison k and l. The preferred embodiments f and g were prepared as variations of the preferred embodiment a in which a proportion of coarse particles was varied while keeping the ratio of the fine particles to coarse particles as constant and the embodiments correspond to the examples of comparison m and n. The preferred embodiment h was prepared by adding a part of the powder in the particle size distribution out of the predetermined range to the powder in the preferred embodiment a and the embodiment corresponds to the example of comparison o.

So, a post-working time is expressed by a sum of a required time for improving up to the surface roughness Ra=0.1 μm of the sintered and infiltrated body and a correcting time of cracks and deformation generated in the sintered body. The sintered body having a superior surface roughness may generate cracks during sintering and infiltrating. In case of the sintered body with Ra=2.0 μm (example of comparison j), it was shown that the correcting time for cracks and deformation needs three times of the surface grinding time.

Due to this fact, in case that the sintered body which does not generate any cracks and deformation, even if the surface roughness is increased, it may shorten a time required in process to generate some merits because the post-working time is not increased, i.e. the postworking time is desirably reduced to a half value.

It is apparent from Table 4 that if the proportion of fine particles with a particle diameter of −10 μm is lower than 3% (example of comparison i), its roughness is decreased, any cracks of the sintered body are not generated but an excess grinding time is required. In turn if the rate exceeds 25% (example of comparison j), a packing density decreases, a shrinkage rate also decreases and then cracks may be generated in the sintered body. Similarly, it is apparent that if the proportion of the middle particle powder (15 to 150 μm) is lower than 35 wt% (example of comparison l), the sintered body may not generate any cracks but the surface roughness is roughened, a grinding operation requires much time and in turn if the rate exceeds 60 wt% (example of comparison k), a packing density decrease and a shrinkage rate is increased to generate some cracks in the sintered body. The proportion of the coarse particle powder (250 to 1000 μm) is lower than 35 wt%, a packing density is not increased but some cracks are generated (examples of comparison m and n), and in turn if the rate exceeds 60 wt%, the sintered body does not generate any cracks, its surface roughness becomes rough, a grinding operation requires much time and then post-working time is increased.

If the total amount of particle powders with particle diameter of −10 μm, 15 to 150 μm and 250 to 1000 μm do not reach 90 wt%, the packing density is not improved and cracks may be generated due to shrinkage through sintering operation. If these materials are more than 90 wt% (example of comparison o), the packing density is not influenced and occurrence of cracks can prohibited (preferred embodiment h). It can be pointed out that any of the preferred embodiments has a relatively low ratio of post-working time and as described above, it may generate a substantial merit in view of its process.

TABLE 4

| Particle Diameter | −10 μm (Fine Particles) | Mixing Rate (wt %) 15~150 μm Middle Particles | 15~63 μm | 63~150 μm | $R_1$ % | 250~1000 μm Coarse Particles | 250~500 μm | 500~1000 μm | $R_2$ % | Others |
|---|---|---|---|---|---|---|---|---|---|---|
| Preferred Embodiment | | | | | | | | | | |
| a | 12 | 40 | 18 | 22 | (55) | 48 | 15 | 33 | (69) | 0 |
| b | 7 | 42 | 19 | 23 | (55) | 51 | 16 | 35 | (69) | 0 |
| c | 22 | 35 | 16 | 19 | (54) | 42 | 13 | 29 | (69) | 0 |
| d | 9 | 55 | 15 | 30 | (55) | 36 | 11 | 25 | (69) | 0 |
| e | 13 | 33 | 15 | 18 | (55) | 53 | 16 | 37 | (69) | 0 |
| f | 10 | 35 | 16 | 19 | (55) | 55 | 17 | 38 | (69) | 0 |
| g | 15 | 52 | 23 | 29 | (55) | 33 | 10 | 23 | (69) | 0 |
| h | 11 | 37 | 17 | 20 | (55) | 44 | 14 | 30 | (69) | 8 |
| Example of Comparison | | | | | | | | | | |
| i | 2 | 45 | 20 | 25 | (55) | 53 | 16 | 37 | (69) | 0 |
| j | 29 | 32 | 14.5 | 17.5 | (55) | 39 | 12 | 27 | (69) | 0 |
| k | 8 | 61 | 29.2 | 35.8 | (55) | 31 | 9.6 | 21.4 | (69) | 0 |
| l | 15 | 28 | 20.1 | 7.9 | (55) | 58 | 18 | 40 | (69) | 0 |
| m | 9 | 30 | 13.5 | 16.5 | (55) | 61 | 19 | 42 | (69) | 0 |
| n | 17 | 55 | 24.7 | 30.3 | (55) | 28 | 9 | 19 | (69) | 0 |
| o | 10 | 34 | 15.3 | 18.7 | (55) | 41 | 12.7 | 28.3 | (69) | 15 |

| Particle Diameter | Surface Roughness Ra (μm) | Packing Density (%) | After-Work Time* Time Ratio** | Grinding | Repair | Shrinkage Rate (%) | Presence or Non-presence of Cracks |
|---|---|---|---|---|---|---|---|
| Preferred Embodiment | | | | | | | |
| a | 3.2 | 75 | 0.5 | O | None | 1.0 | None |
| b | 3.3 | 73 | 0.5 | O | None | 0.9 | None |
| c | 2.7 | 78 | 0.375 | O | None | 1.2 | None |
| d | 3.0 | 70 | 0.5 | O | None | 1.4 | None |
| e | 3.5 | 79 | 0.5 | O | None | 0.8 | None |
| f | 3.6 | 77 | 0.625 | O | None | 0.8 | None |
| g | 3.4 | 72 | 0.5 | O | None | 1.3 | None |
| h | 3.3 | 73 | 0.5 | O | None | 0.9 | None |
| i | 4.7 | 69 | 1 | O | None | 0.8 | None |
| j | 2.0 | 80 | 1 | O | O | 4.4 | Produced |
| k | 3.6 | 65 | 1.25 | O | O | 3.1 | Produced |
| l | 4.1 | 81 | 1 | O | None | 1.0 | None |
| m | 4.2 | 79 | 1 | O | None | 0.9 | None |
| n | 3.4 | 64 | 1.1 | O | O | 3.0 | Produced |
| o | 3.4 | 65 | 1.1 | O | O | 3.0 | Produced |

Remarks:
$R_1$: Ratio of (63 to 150 μm) particles (15 to 150 μm) particles
$R_2$: Ratio of (500 to 1000 μm) particles (250 to 1000 μm) particles
(Note)
*After-work time = Grinding time + repairing time. Provided that the grinding time is one in which Ra = 0.1 μm is attained. Grinding is carried out with Emery sheet.
**Example of comparison j is 1.

Preferred Embodiment 7

Powder of which rate of particle size configuration in the middle particles and coarse particles as indicated in Table 5 was varied was used to make infiltrated sintered body under a condition of charging, sintering, infiltrating similar to that of the preferred embodiment 6 and then their characteristic was surveyed. In Table 5 are indicated a surface roughness, a packing density and a relation between a shrinkage rate and cracks in reference to the present invention and the examples of comparison in total.

The powder used in the preferred embodiment q was such that the middle particle powder and coarse particle powder were crushed by ten times with a hammer mill to make some spherical particles and then the particles were adjusted to a particle size before their crushing and then applied to a test. In case that a degree of making spherical particles is expressed by a ratio between a long diameter a and a short diameter b (a/b), mean value in the twenty particles under an optical microscope observation was 1.05 for the coarse particle powder and 1.2 for middle particle powder. A ratio between a long diameter and a short diameter of powder not formed into a spherical particle was 1.40 for coarse particle powder and 1.45 for middle particle powder. In addition, an evaluation for a degree of flow was 15.5 sec/50 g for middle particle powder before spherical particle making operation and 17.9 sec/50 g after spherical particle making operation. However, the coarse particle powder could not be measured for its degree of flow due to a large particle diameter.

The example of comparison r shows a case in which a proportion of 63 to 150 μm in the middle particles (15 to 150 μm) does not reach 35 wt%, and the example of comparison s shows a case in which a proportion of 500 to 1000 μm in the coarse particles (250 to 1000 μm) does not reach 35 wt%. It is apparent from Table 5 that in case that each of the proportion of 63 to 150 μm in the middle particles (15 to 150 μm) and the proportion of 500 to 1000 μm in the coarse particles (250 to 1000 μm) is lower than 35 wt%, the packing density is not increased and a shrinkage rate is increased, thereby the cracks are generated.

Making of spherical particles may improve a packing density and a surface roughness, a shrinkage rate is also restricted and a more improved characteristic through forming into the spherical particle can be attained.

between a shrinkage rate and cracks in reference to the present invention and the examples of comparison.

TABLE 5

| Particle Diameter | Mixing Rate (wt %) −10 μm | 15 μm~150 μm | 15 μm~63 μm | 63 μm~150 μm | $R_1$ % | 250 μm~1000 μm | 250 μm~500 μm | 500 μm~1000 μm | $R_2$ % |
|---|---|---|---|---|---|---|---|---|---|
| Preferred Embodiment a | 12 | 40 | 18 | 22 | (55) | 48 | 15 | 33 | (69) |
| Preferred Embodiment p | 12 | 40 | 24 | 16 | (40) | 48 | 24 | 24 | (50) |
| Preferred Embodiment q | 12 | 40 | 18 | 22 | (55) | 48 | 15 | 33 | (69) |
| Preferred Embodiment r | 12 | 40 | 19 | 13 | (32) | 48 | 24 | 24 | (50) |
| Preferred Embodiment s | 12 | 40 | 24 | 16 | (40) | 48 | 18 | 16 | (34) |

| Particle Diameter | Others | Surface Roughness Ra (μm) | Packing Density | Shrinkage Rate (%) | Presence or Non-presence of Cracks |
|---|---|---|---|---|---|
| Preferred Embodiment a | 0 | 3.2 | 75 | 1.0 | None |
| Preferred Embodiment p | 0 | 2.8 | 65 | 1.2 | None |
| Preferred Embodiment q | 0 | 2.5 | 81 | 0.6 | None |
| Preferred Embodiment r | 0 | 2.6 | 65 | 3.4 | Cracks |
| Preferred Embodiment s | 0 | 3.3 | 62 | 3.4 | Cracks |

*After making into ball-like form with a hammer mill. A grain size configuration is adjusted.
$R_1$: Ratio of (63 to 150 μm) particles to (15 to 150 μm) particles.
$R_2$: Ratio of (500 to 1000 μm) particles to (250 to 1000 μm) particles.

Preferred Embodiment 8

Powder in which stainless short fibers acting as additive agent were mixed under various rates on the basis of the powder used in the preferred embodiment a was used, a sintered body was made under the charging, sintering, infiltrating condition similar to that of the preferred embodiment 6 and then its characteristic was surveyed. Stainless short fibers are of SUS304. Fibers with a long diameter of about 3 mm and a short diameter of about 1.03 mm were used. In Table 6 are indicated a surface roughness, a packing density and a relation It is apparent from Table 6 that adding of short fibers may generate a reduction of packing density a little, and the shrinkage rate is restricted under effect of adding short fibers and further the strength is also improved.

In the example of comparison v , an adding rate of stainless short fibers was 16% and the packing density was excessively reduced, the shrinkage rate was increased and some cracks were generated. Strength was also deteriorated.

With the foregoing, it is preferable to have 15 wt% or less as an adding amount of short fiber.

TABLE 6

| Particle Diameter | Mixing Rate (wt %) −10 μm | 15 μm~150 μm | 15 μm~63 μm | 63 μm~150 μm | 63 μm~150 μm $R_1$ % | 250 μm~1000 μm | 250 μm~500 μm | 500 μm~1000 μm | $R_2$ % | Others | Short Fibers Added |
|---|---|---|---|---|---|---|---|---|---|---|---|
| Preferred Embodiment a | 12 | 40 | 18 | 22 | (55) | 48 | 15 | 33 | (69) | 0 | 0 |
| Preferred Embodiment t | (Same particle size distribution as that of powder a)* | | | | | | | | | 0 | 2 |
| Preferred Embodiment u | (Same particle size distribution as that of powder a)* | | | | | | | | | 0 | 10 |
| Example of Comparison v | (Same particle size distribution as that of powder a)* | | | | | | | | | 0 | 16 |

| Particle | Surface Roughness | Packing | Transverse Rupture | Shrinkage | Presence or non-presence |
|---|---|---|---|---|---|

TABLE 6-continued

| Diameter | Ra (μm) | Density | (kgf/mm²) | Rate (%) | of cracks |
|---|---|---|---|---|---|
| Preferred Embodiment a | 3.2 | 75 | 140 | 1.0 | None |
| Preferred Embodiment t | 3.2 | 73 | 160 | 1.0 | None |
| Preferred Embodiment u | 3.6 | 70 | 170 | 0.8 | None |
| Example of Comparison v | 4.0 | 65 | 110 | 3 | Presence |

*Mixing rate for particles except short fibers
$R_1$ : Ratio of (63 to 150 μm) particles to (15 to 150 μm) particles
$R_2$ : Ratio of (500 to 1000 μm) Particles to (250 to 1000 μm) particles Preferred Embodiment 9

As iron-base powder, the inventors used iron-base powder in which 40 weight part of atomized pure iron powder with a mean particle diameter of 139 μm (particle size range of 100 to 200 μm , 25 weight part of atomized pure iron powder with a mean particle diameter of 29 μm (particle size range of 15 to 63 μm) and 25 weight part of carbonyl iron powder with a mean particle diameter of 4.2 μm (particle size range of 10 μm or less) were mixed and the particle size configuration was adjusted. 5.7 weight part of aluminum powder of purity of 98% and with a mean particle diameter of 61 μm (particle size range of 45 to 100 μm) was mixed with 94.3 weight part of mixed iron powder to make mixed powder.

As the molding die, a ceramic mold with a surface roughness (Ra value) of 0.3 μm was used and the mixed powder was vibratory charged. Copper infiltrating material with brass powder being press formed into a block was placed on the surface of the charged body. The ceramic mold, powder charged body, infiltrating material were loaded in a furnace, heated within nitrogen gas atmosphere for 70 minutes at 1010° C. The charged body was sintered, then its temperature was increased up to 1130° C. for two hours to promote the infiltrating operation by melting the infiltrating material. A holding time at 1130° C. was 100 minutes and then the furnace was cooled.

After cooling, the infiltrated sintered body was taken out of the ceramic mold, its size was measured, shrinkage rate during sintering and infiltrating was calculated to get 1.4%.

A surface roughness at the side surface contacting with the ceramic mold was measured to get Ra =1.6 μm. The sintered body with this value can be used as a mold for plastic injection molding.

Preferred Embodiment 10

As iron base powder, the iron power having the same particle size configuration as that of the preferred embodiment 9 was used. 3.5 weight part of alumina powder with a mean particle diameter of 40 μm (particle size range of 15 to 100 μm) was mixed with 96.5 weight part of mixed powder to make mixed powder.

This mixed powder was processed in the same manner as that of the previous preferred embodiments.

After cooling, the infiltrated sintered body was taken out of the ceramic mold, its size was measured, and a shrinkage rate during sintering and infiltrating was calculated to get 1.7%.

Surface roughness at the side surface contacting with the ceramic mold was measured to get Ra=1.5 μm. The sintered body with this value can be used as a die of plastic injection molding, for example.

Example of Comparison 1

Test was carried out in the same manner as that of the preferred embodiment 9 except the case in which either aluminum powder or alumina powder was not mixed.

As a result, a shrinkage rate during sintering and infiltrating operation was 5.6%. In this way, if the shrinkage is high (over 2%), if a mold having a complex shape is applied to restrict the material to apply a sintering action, resulting in that the sintered body may have a restricting crack and so the sintering can not be carried out for it.

Surface roughness was Ra=1.7 μm and this was the same as that of the preferred embodiment 1.

Preferred Embodiment 11

8.1 weight part of aluminum powder of purity of 99% and with a mean particle diameter of 36 μm (particle size range of 15 to 63 μm) was mixed with 91.9 weight part of atomized alloy steel powder (1.5% Ni, 0.5% Cu, 0.5% Mo) with a mean particle diameter of 67 μm (particle size of 10 to 180 μm) and then a test was carried out under the same condition as that of the preferred embodiment 9 other than the above condition.

Preferred Embodiment 12

5.2 weight part of alumina powder with a mean particle diameter of 36 μm (particle size range of 15 to 63 μm) was mixed with 94.8 weight part of atomized alloy steel powder (1.5% Ni, 0.5% Cu, 0.5% Mo) in the same manner as that of the preferred embodiment 11, and a test was carried out under the same condition as that of the preferred embodiment 5 other than the above. As a result, a shrinkage rate during sintering and infiltrating operation was 0.9% and a surface roughness of the sintered body was a satisfactory value of Ra=1.9 μm.

Example of Comparison 2

A test was carried out under the same condition as that of the preferred embodiment 11 other than the condition in which neither aluminum powder nor alumina powder was not mixed.

A shrinkage rate during sintering and infiltrating operation was a high value of 6.8%, surface roughness was a satisfactory value of Ra=1.6 μm. However, a restricting crack was generated in the same manner as that of the example of comparison 1, resulting in that the sintering could not performed.

Preferred Embodiment 13

Atomized pure iron powder with a different particle diameter indicated in Table 7 was prepared, mixed as shown in Table 8 to form charging powder. As a mixing work, V type mixer was used.

As adhered powder, carbonyl iron powder with a mean particle diameter of 8.0 μm was used.

A molding die for charging operation was ceramic die with surface roughness Ra=0.3 μm.

An adhering operation was carried out by mixing aceton containing 1 wt% of camphor and applying with brush some paste-like mixed material. Its thickness was 3 mm. Further, as a comparison material, the molding die having no adhered material was prepared.

A charging was carried out while applying vibration.

The molding die charged with this powder was sintered in a hydrogen gas for sixty minutes at 1120° C. After sintering, the mold was decomposed and surface roughness of a surface contacting with the ceramic mold was surveyed. The powder layer adhered to the ceramic die was sufficiently contacted with the charged powder.

In Table 8 is illustrated the present invention and the examples of comparison in reference to the surface roughness. It shows that the materials of the present invention (a, b, c) are quite superior than the materials of comparison (d, e, f), respectively.

Preferred Embodiment 4

As charging powder, D powder shown in Table 7 was used and adhering powder, carbonyl iron powder which was the same as that of the preferred embodiment 13 was used. A sintering work was carried out under the same condition as that of the preferred embodiment. Thickness of the adhering powder was varied by 0.5, 1, 3, 10 and 14 mm, respectively and influence of the thickness was surveyed.

In Table 9 is indicated influence of thickness against some cracks in the surface. If the adhering layer exceeds 10 mm, the surface shows a certain cracks.

TABLE 7

| Classification | Type | Symbol | Mean Particle Diameter (μm) | Particle Diameter (μm) |
|---|---|---|---|---|
| For Charging | Pure Iron Powder | A | 230 | −500/+150 |
| | | B | 29 | −63/+15 |
| | | C | 4.8 | −10 |
| | | D | 72 | −145 (−100 mesh) |
| For Adhering | Carbonyl Iron Powder | E | 8.0 | — |

TABLE 8

| | Charging Powder | | Adhered Powder | | Sintered Body |
|---|---|---|---|---|---|
| No. | Type | Mixing Rate (wt %) | Type | Thickness (mm) | Surface Roughness Ra (μm) |
| a | D | — | E | 3 | 0.76 |
| b | A, B, C | A: 70 wt % B: 20 wt % C: 10 wt % | E | 3 | 0.61 |
| c | A, B, C | A: 50 wt % B: 30 wt % C: 20 wt % | E | 3 | 0.64 |

TABLE 8-continued

| | Charging Powder | | Adhered Powder | | Sintered Body |
|---|---|---|---|---|---|
| No. | Type | Mixing Rate (wt %) | Type | Thickness (mm) | Surface Roughness Ra (μm) |
| d* | D | — | — | — | 4.1 |
| e* | A, B, C | A: 70 wt % B: 20 wt % C: 10 wt % | — | — | 5.9 |
| f* | A, B, C | A: 50 wt % B: 30 wt % C: 20 wt % | — | — | 2.2 |

*Example of Comparison

TABLE 9

| | | Adhered Powder | | Surface | Surface Cracks |
|---|---|---|---|---|---|
| No. | Charging Powder | Type | Thickness (mm) | Roughness Ra (μm) | O Non-presence X Presence |
| g | D | E | 0.5 | 0.74 | O |
| h | | E | 1 | 0.74 | O |
| a | | E | 3 | 0.76 | O |
| i | | E | 10 | 0.76 | O |
| j* | | E | 14 | 0.76 | X |

*Example of Comparison

Preferred Embodiment 15

As charging powder, D powder indicated in Table 7 was used and as adhering powder, powder with a mean particle diameter shown in Table 10 having classified atomized pure iron powder was used. Thickness of the adhering powder was 1 mm, sintering operation was carried out under the same condition as that of the preferred embodiment 13 and influence of the adhering powder against the surface roughness was surveyed. As comparing material, the inventors prepared the material having adhering powder with a mean particle diameter of 23 μm (m) and another material having as charging powder mixed powder of A, B, C and having no adhering powder (f).

In Table 10 is indicated surface roughness of the produced sintered body. If a mean particle diameter of the adhered powder exceeds 20 μm, surface roughness becomes about 2 μm, and this is approximately the same as that of the sintered body f in which a grain size configuration is applied to the charging powder and the adhering powder is not used. In order to get a sintered body with surface roughness Ra=1 μm or less, it is necessary to have a mean particle diameter of adhering powder of 20 μm or less.

TABLE 10

| | | Adhered Powder | | | |
|---|---|---|---|---|---|
| No. | Charging Powder | Type | Thickness (mm) | Mean Particle Diameter (μm) | Surface Roughness Ra (μm) |
| K | D | Pure Iron Powder | 1 | 10 | 0.79 |
| l | | | | 18 | 0.92 |
| m* | | | | 23 | 2.0 |
| f* | A, B, C A: 50 wt % B: 30 wt % C: 20 wt % | — | — | — | 2.2 |

*Example of comparison

What is claimed is:

1. A method for preparing a powder metallurgical sintered body comprising the steps of:

charging into a vibrating molding die a mixture of three types of metallic powder substantially constituted by coarse particles having particle diameters of 150 to 1000 μm, middle particles having particle diameters of 15 to 150 μm and fine particles having particle diameters of 10 μm or less, each of the coarse particles, middle particles and fine particles being of a continuous particle size distribution, and the coarse particle size distribution, middle particle size distribution and fine particle size distribution being discrete from each other;

heating said charged mixture together with a molding die to cause sintering thereof; and infiltrating into said sintered body another metal having a lower melting point than that of said metallic powder.

2. A method for preparing a powder metallurgical sintered body as set forth in claim 1 in which a metallic powder is used wherein substantially the fine particles having particle diameters of 10 μm or less comprise 10–50 wt% of the entire amount, the middle particles have particle diameters of 15–63 μm and comprise 20 wt% or more of the entire amount, and the coarse particles have particle diameters of 150–500 μm and comprise 20–60 wt% of the entire amount.

3. A method for preparing a powder metallurgical sintered body as set forth in claim 1 in which a metallic powder is used wherein substantially the fine particles having particle diameters of 10 μm or less comprise 3–25 wt% of the entire amount, the middle particles having particle diameters of 15–150 μm comprise 30–60 wt% of the entire amount, the middle particles having particle diameters of 63 μm or more comprising 35 wt% or more in respect to the middle particles having particle diameters of 15–150 μm, and the coarse particles have particle diameters of 250–1000 μm and comprise 30–60 wt% of the entire amount, the coarse particles having particle diameters of 500 μm or more being 35 wt% or more in respect to the coarse particles having particle diameters of 250–1000 μm.

4. A method for preparing a powder metallurgical product as set forth in any one of claims 1, 2 or 3 in which said metallic powder is an iron-base powder.

5. A method for preparing a powder metallurgical product as set forth in any one of claims 1, 2 or 3 in which said metallic powder is an iron-base powder, and wherein aluminum powder is mixed with the iron-base powder and then applied.

6. A method for preparing a powder metallurgical product as set forth in any one of claims 1, 2 or 3 in which said metallic powder is an iron-base powder, and wherein a non-metallic powder is mixed with the metallic powder and then applied.

7. A method for preparing a powder metallurgical product as set forth in any one of claims 1, 2 or 3 in which said metallic powder is mixed with metallic short fibers within a range not exceeding 15 wt% and applied.

8. A method for preparing a powder metallurgical product as set forth in any one of claims 1, 2 or 3 in which the step of charging metallic powder into the molding die is carried out under vibratory acceleration of said die at 0.5 G or more and an amplitude of 20 μm or more.

9. A method for preparing a powder metallurgical product as set forth in any one of claims 1, 2 or 3 in which the step of charging metallic powder into the molding die while applying vibration to the die is carried out under a pressure of 1 $Kg/cm^2$ or less.

10. A method for preparing a powder metallurgical product as set forth in any one of claims 1, 2 or 3 in which said metallic powder is an iron-base powder, and wherein the step of charging metallic powder into the molding die while applying vibration to the die is carried out under a pressure of 1 $Kg/cm^2$ or less.

11. A method for preparing a powder metallurgical product as set forth in any one of claims 1, 2 or 3 in which said metallic powder is an iron-base powder, wherein aluminum powder is mixed with the iron-base powder, and wherein the step of charging metallic powder into the molding die while applying vibration to the die is carried out under a pressure of 1 $Kg/cm^2$ or less.

12. A method for preparing a powder metallurgical product as set forth in any one of claims 1, 2 or 3 in which said metallic powder is an iron-base powder, wherein non-metallic powder is mixed with the iron-base powder and wherein the step of charging the metallic powder into the molding die while applying vibration to the die is carried out under a pressure of 1 $Kg/cm^2$ or less.

13. A method for preparing a powder metallurgical product as set forth in any one of claims 1, 2 or 3 in which metallic short fibers are mixed with said metallic powder within a range not exceeding 15 wt% and used, and wherein the step of charging the metallic powder into the molding die while applying vibration to the die is carried out under a pressure of 1 $Kg/cm^2$ or less.

14. A method for preparing a powder metallurgical product as set forth in claims 1, 2, or 3 in which the step of charging the metallic powder into the molding die while applying vibration to the die is carried out under vibratory acceleration of said mold die at 0.5 G or more, and wherein its amplitude is 20 μm or more and the pressure is 1 $Kg/cm^2$ or less.

15. A method for preparing a powder metallurgical product as set forth in any one of claims 1, 2 or 3 in which said another metal having a lower melting point than that of said metallic powder used in the infiltrating step is one or two elements selected from the group consisting of copper, copper alloy, zinc and zinc alloy.

16. A method for preparing a powder metallurgical product as set forth in any one of claims 1, 2 or 3 in which said metallic powder is an iron-base powder, and said another metal having a lower melting point is one or two or more elements selected from the group consisting of copper, copper alloy, zinc and zinc alloy.

17. A method for preparing a powder metallurgical product as set forth in any one of claims 1, 2 or 3 in which said metallic powder is an iron-base powder, aluminum powder is mixed with the iron-base powder and another metal having a lower melting point used in the step of infiltrating, wherein said another metal having a lower melting point than that of said metallic powder is one or two or more elements selected from the group consisting of copper, copper alloy, zinc and zinc alloy.

18. A method for preparing a powder metallurgical product as set forth in any one of claims 1, 2 or 3 in which said metallic powder is an iron-base powder, a non-metallic powder is mixed with the iron-base powder, and wherein said another metal having a lower melting point used in the step of infiltrating is one or two or more elements selected from the group consisting of copper, copper alloy, zinc and zinc alloy.

19. A method for preparing a powder metallurgical product as set forth in any one of claims 1, 2 or 3 in which metallic short fibers are mixed with said metallic powder within a range not exceeding 15 wt%, and wherein said another metal used in the step of infiltrating is one or two or more elements selected from the group consisting of copper, copper alloy, zinc and zinc alloy.

20. A method for preparing a powder metallurgical product as set forth in any one of claims 1, 2 or 3 in which the step of charging metallic powder into the molding die is carried out under vibratory acceleration of said die at 0.5G or more and under an amplitude of 20 μm or more, and wherein said another metal having a lower melting point used in the step of infiltrating is one or two or more elements selected from the group consisting of copper, copper alloy, zinc and zinc alloy.

21. A method for preparing a powder metallurgical product as set forth in any one of claims 1, 2 or 3 in which the step of charging metallic powder into the molding die while applying vibration to the die is carried out under a pressure of 1 $Kg/cm^2$ or less, and wherein said another metal having a lower melting point used in the step of infiltrating is one or two or more elements selected from the group consisting of copper, copper alloy, zinc and zinc alloy.

22. A method for preparing a powder metallurgical product as set forth in any one of claims 1, 2 or 3 in which, prior to the step of charging said metallic powder while applying vibration to the molding die, a step is performed of adhering and forming to the surface of said molding die a layer having a thickness of 10 mm or less composed of said metallic powder or other metallic powder having a mean particle diameter of 20 μm or less.

23. A method for preparing a powder metallurgical product as set forth in any one of claims 1, 2 or 3 in which said metallic powder is an iron-base powder, and wherein prior to the step of charging said metallic powder into the molding die while vibrating the die, a step is performed of adhering and forming to the surface of said molding die a layer having a thickness of 10 mm or less composed of said metallic powder or other metallic powder having a mean particle diameter of 20 μm or less.

24. A method for preparing a powder metallurgical product as set forth in any one of claims 1, 2 or 3 in which said metallic powder is an iron-base powder, wherein aluminum powder is mixed with the iron-base powder, and wherein prior to the step of charging said metallic powder into the molding die while vibrating the die, a step is performed of adhering and forming to the surface of said molding die a layer having a thickness of 10 mm or less composed of said metallic powder or other metallic powder having a mean particle diameter of 20 μm or less.

25. A method for preparing a powder metallurgical product as set forth in any one of claims 1, 2 or 3 in which prior to the step of charging said metallic powder into the molding die while vibrating the die, a step is performed of adhering and forming to the surface of said molding die a layer having a thickness of 10 mm or less composed of said metallic powder or other metallic powder having a mean particle diameter of 20 μm or less, said metallic powder being an iron-base powder, and wherein non-metallic powder is mixed with the iron-base powder.

26. A method for preparing a powder metallurgical product as set forth in any one of claims 1, 2 or 3 in which prior to the step of charging said metallic powder into the molding die while vibrating the die, a step is performed of adhering and forming to the surface of said molding die a layer having a thickness of 10 mm or less composed of said metallic powder or other metallic powder having a mean particle diameter of 20 μm or less, and metallic short fibers are mixed with said metallic powder within a range not exceeding 15 wt%.

27. A method for preparing a powder metallurgical product as set forth in any one of claims 1, 2 or 3 in which prior to the step of charging said metallic powder to the molding die while vibrating the die, a step is performed of adhering and forming to the surface of said molding die a layer having a thickness of 10 mm or less composed of said metallic powder or other metallic powder having a mean particle diameter of 20 μm or less, and wherein the step of charging metallic powder into the molding die is carried out under vibratory acceleration of said die at 0.5 G or more and at an amplitude of 20 μm or more.

28. A method for preparing a powder metallurgical product as set forth in any one of claims 1, 2 or 3 in which prior to the step of charging said metallic powder into the molding die while vibrating the die, a step is performed of adhering and forming to the surface of said molding die a layer having a thickness of 10 mm or less composed of said metallic powder or other metallic powder having a mean particle diameter of 20 μm or less, and the step of charging metallic powder into the molding die while vibrating the die is carried out under a pressure of 1 $Kg/cm^2$ or less.

29. A method for preparing a powder metallurgical product as set forth in any one of claims 1, 2 or 3 in which prior to the step of charging said metallic powder into the molding die while vibrating the die, a step is performed of adhering and forming to the surface of said molding die a layer having a thickness of 10 mm or less composed of said metallic powder or other metallic powder having a means particle diameter of 20 μm or less, and wherein said another metal having a lower melting point used in the step of infiltrating is one or two or more elements selected from the group consisting of copper, copper alloy, zinc, and zinc alloy.

* * * * *